United States Patent [19]

Hashiguchi

[11] Patent Number: 5,026,296

[45] Date of Patent: Jun. 25, 1991

[54] ELECTRICAL CONNECTOR EQUIPPED WITH RELEASE MECHANISM

[75] Inventor: Osamu Hashiguchi, Tokyo, Japan

[73] Assignee: Japan Aviation Electronics Industry, Limited, Tokyo, Japan

[21] Appl. No.: 488,651

[22] Filed: Mar. 5, 1990

[51] Int. Cl.[5] ..... H01R 13/62

[52] U.S. Cl. ..... 439/159; 439/374

[58] Field of Search ..... 439/152–160, 439/325–328, 630–637, 374

[56] References Cited

U.S. PATENT DOCUMENTS

| | | | |
|---|---|---|---|
| 4,128,288 | 12/1978 | Zachry et al. | 439/152 |
| 4,778,401 | 10/1988 | Boudreau et al. | 439/157 |
| 4,810,200 | 3/1989 | Sakamoto | 439/155 |
| 4,832,610 | 5/1989 | Matsuoka | 439/159 |

FOREIGN PATENT DOCUMENTS

| | | | |
|---|---|---|---|
| 2512193 | 10/1976 | Fed. Rep. of Germany | 439/152 |

*Primary Examiner*—David L. Pirlot

*Attorney, Agent, or Firm*—Laff, Whitesel, Conte & Saret

[57] ABSTRACT

An electrical connector has a release mechanism for releasing a mating element. An insulator frame has a plurality of electric contacts. A flat plate on the frame has mating electric contacts. The flat plate is manually moved to release the mating element from engagement with the connector. To reduce a force required for releasing the connector, a lever is pivotally supported on the frame. The lever has an end portion mechanically coupled to the flat plate and an opposite end mechanically coupled to an ejector. When the ejector is pushed, the lever is rotated to move the flat plate together with the mating element in the release direction.

5 Claims, 5 Drawing Sheets

ELECTRICAL CONNECTOR EQUIPPED WITH RELEASE MECHANISM

BACKGROUND OF THE INVENTION

1) Field of the Invention

The present invention relates to an electrical connector equipped with a release mechanism for releasing a mating element from engagement with the connector.

2) Description of the Prior Art

Conventionally, a connector equipped with a release mechanism comprises an insulator frame with a plurality of conductive pin contacts fixed thereto and an insulator plate mounted on the frame. The plate is for carrying a mating element, for example, a socket connector with socket contacts and is slidable in a direction or an engaging direction so as to establish connection between the pin contacts and the socket contacts. The plate is also provided with hooks which engage the socket connector carried on the plate so that the socket connector is released from connection between the pin and socket contacts by moving the plate in the opposite direction or a release direction. A knob is mounted on the top surface of the plate in a manner which allows easy manual sliding of the plate.

When the knob is manually operated to force the plate moved in the release direction so as to release the socket connector from the engagement with the connector, the plate is subjected to a moment due to the force acted on the knob, because the knob is not in the center of the plate. Further, the plate is pressed onto the frame so that smooth sliding operation of the plate is unfortunately barred by the friction therebetween.

Further, in the conventional connector, a stroke of the manually-operated knob is equal to a stroke of the plate so that a force required for sliding the plate cannot be made less than a force required for releasing the connection between the pin and the socket contacts. Therefore, release of the mating element is not smoothly performed.

SUMMARY OF THE INVENTION

An object of the present invention is to provide an electrical connector equipped with a release mechanism for releasing a mating element from engagement with connector wherein it is possible to readily release the mating element with a reduced releasing force.

Another object of the present invention is to provide an electrical connector equipped with a release mechanism wherein it is possible to release a mating element from engagement with the connector with a reduced moment of force on the mating element due to manual operation.

The present invention is directed to an electrical connector having an electric contact and being equipped with a release mechanism for releasing a mating element from engagement with the connector, the mating element having a mating contact for electrically connecting with the contact.

According to the present invention, the electrical connector comprises: an insulator frame body having a hollow portion with an open end and the electric contact fixed in the hollow portion for connecting the mating element; an insulator flat plate slidably inserted into the hollow portion of the frame body through the open end for carrying the mating element in an engaging and a release direction to thereby connect and disconnect the mating contact with the electric contact, the flat plate having hooking means for mechanically engaging the mating element carried on the flat plate; lever means pivotally supported on the frame body and having an end portion mechanically coupled with the flat plate and an opposite end portion; and manually-operated means coupled to the opposite end portion of the lever means and manually operated for rotating the lever means to thereby move the flat plate in the release direction so that the mating element on the flat plate can be forcedly released from the connection between the electric contact and the mating contact.

DESCRIPTION OF THE PREFERRED EMBODIMENT

Prior to description of embodiments of the present invention, a conventional electrical connector equipped with a release mechanism will be described with reference to FIG. 1 to help the better understanding of the present invention.

Figure 1:
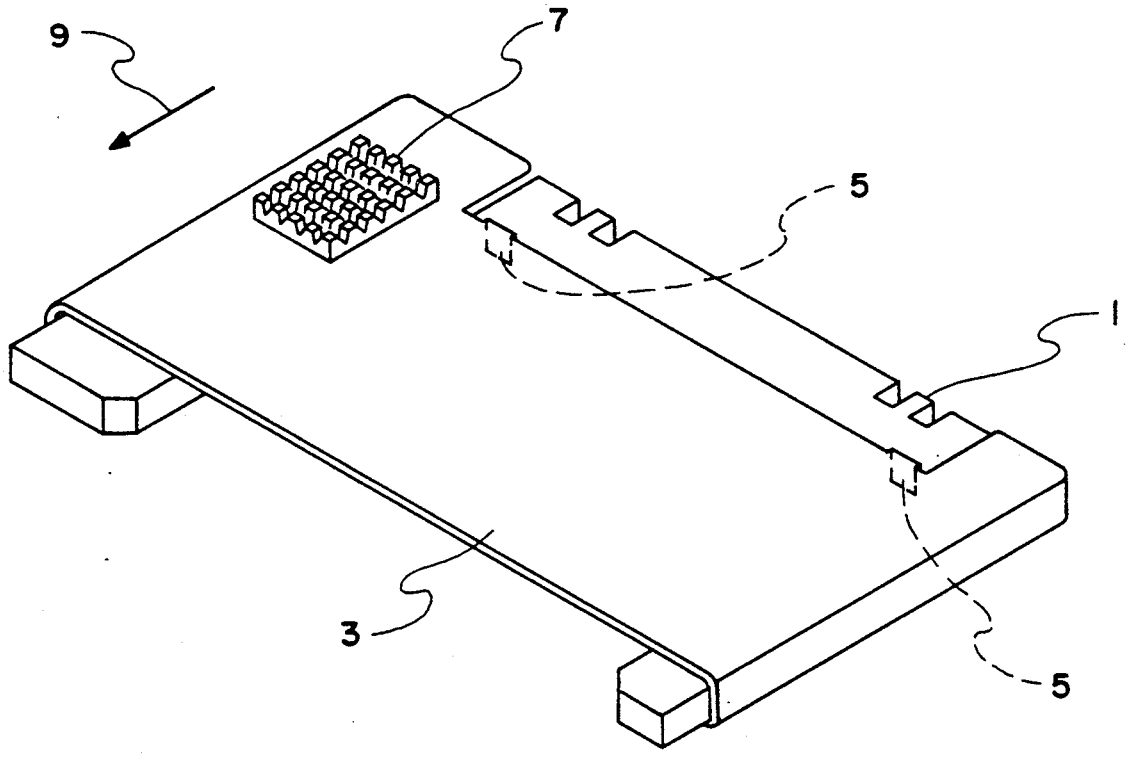
FIG. 1 PRIOR ART
FIG. 1 is a perspective view of a conventional electrical connector equipped with a release mechanism.

Referring to FIG. 1, the electrical connector shown therein comprises an insulator frame 1 having a plurality of conductive pin contacts (not shown) and an insulator plate 3 slidably mounted on the frame 1 for carrying a mating element (not shown) on a back side of the plate 3 in FIG. 1. The plate 3 has projections 5 for engaging or fitting to the mating element carried on the plate, and a knob 7 fixedly mounted on a top surface of the plate 3 at a position above the frame 1 for manually operating the plate 3 to slide on the frame 1.

The pin contacts and the socket contacts are engaged and connected with each other in a connection or engagement state between the connector and the mating element. In order to release the mating element from the engagement state, the knob 7 is manually operated or pressed and moved in a direction shown by an arrow 9 in FIG. 1. As a result, the plate 3 carrying the mating element is also moved in the direction 9 so that the engagement state is released.

However, the conventional connector has problems as described in the preamble of the description.

Now, referring to FIGS. 2 to 5, the electrical connector equipped with a release mechanism shown therein comprises an insulator flat plate 11 and an insulator frame 13 assembled with the plate 11.

The frame 13 is provided with a contact holding plate 17 of insulator assembled with the frame 13. The frame 13 and the contact holding plate 17 are linked or mechanically coupled to each other by a mutual engagement of a recess 42 and a projection 44 shown in FIG. 4. The contact holding plate 17 has a plurality of conductive pin contacts 15 received thereto.

The frame 13 has a hollow portion with an open end 22 in which the plate 11 is held in a manner allowing the plate 11 to move or slide in a direction 18 towards the contact holding plate 17 and in the opposite direction.

The plate 11 is for carrying a mating element 19 such as a socket connector with a plurality of socket contacts (not shown) to mate with the pin contacts 15. A plurality of, or two, hooks 21 are formed at a leading edge of the plate 11 and bent at a right angle to the plate 11 to thereby engage with the mating element carried on the plate 11.

A cylindrical or pin-like support 23 is provided in the vicinity of the open end 22 in the frame 13. The support 23 is integrally formed with the frame 13.

A lever 27 is provided with a hole 25 at an intermediate portion in which the support 23 is engaged in a rotatable manner. That is, the lever 27 is pivotally supported on the support 23. An elongated hole or slit 29 is formed at one end of the lever 27. The elongated hole 29 is coupled or fitted onto a projection 31 formed on the plate 11. Therefore, the rotation or the pivotal movement of the lever 27 around the support 23 is converted into a linear movement of the plate 11 in the direction 18.

An ejector or a manually-operated key block 34 is incorporated in the side section of the frame 13 for actuating the lever 27 to move the plate 11 in the direction 18. The frame 13 has a chamber 35 adjacent to the hollow portion. The chamber 35 has an opening 36 adjacent to the open end 22. The ejector 34 is slidably held in the chamber 35. A groove 32 is provided in the side surface of the ejector 34. The other end of the lever 27 is inserted into the groove 32 of the ejector 34, so that the lever 27 is operatively coupled with the ejector 34 and is rotated by linear movement of the ejector 34 in the direction 18.

Figure 4:
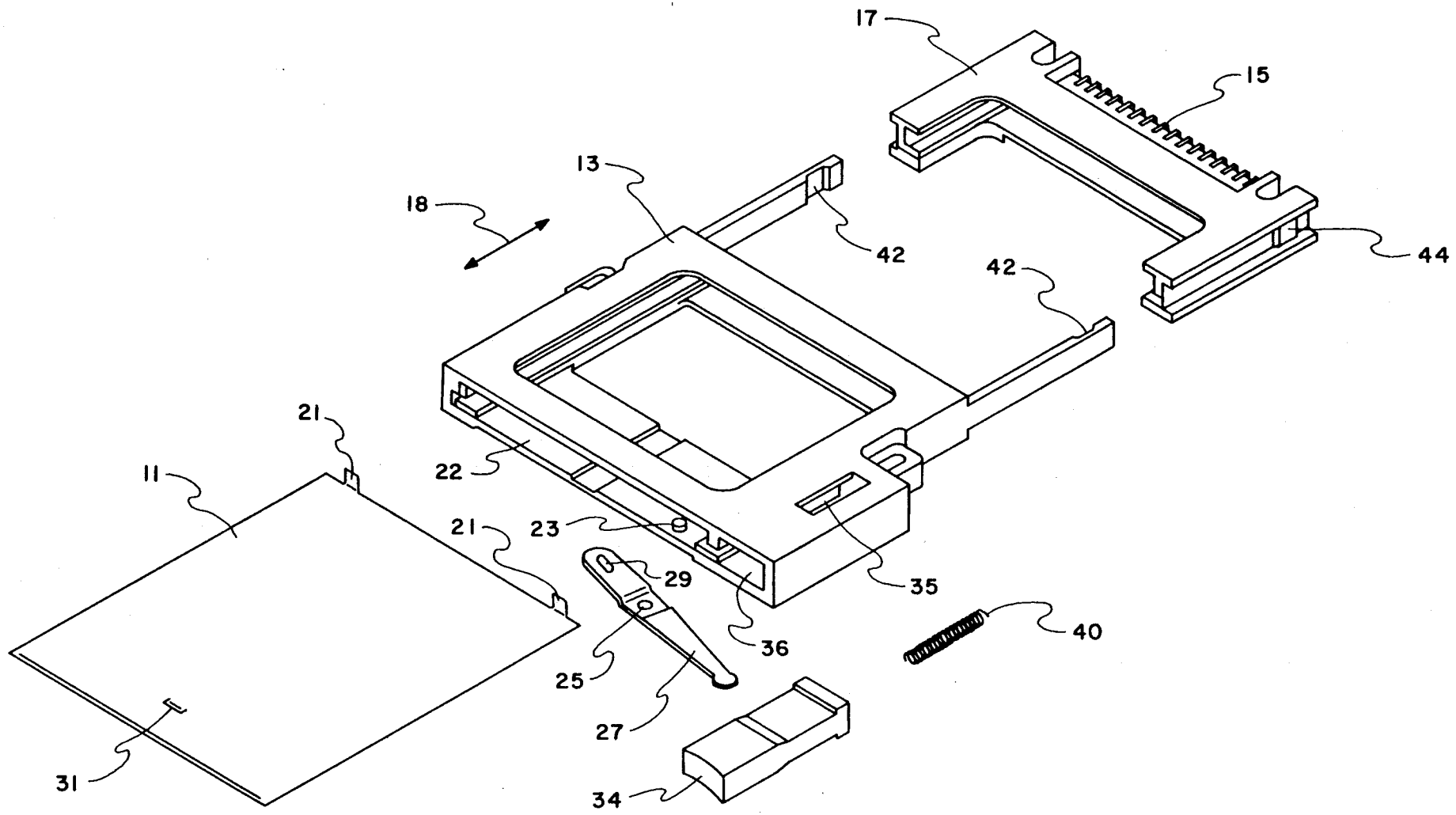
FIG. 4 is an exploded sectional view of the electrical connector of FIG. 2.
Figure 5:
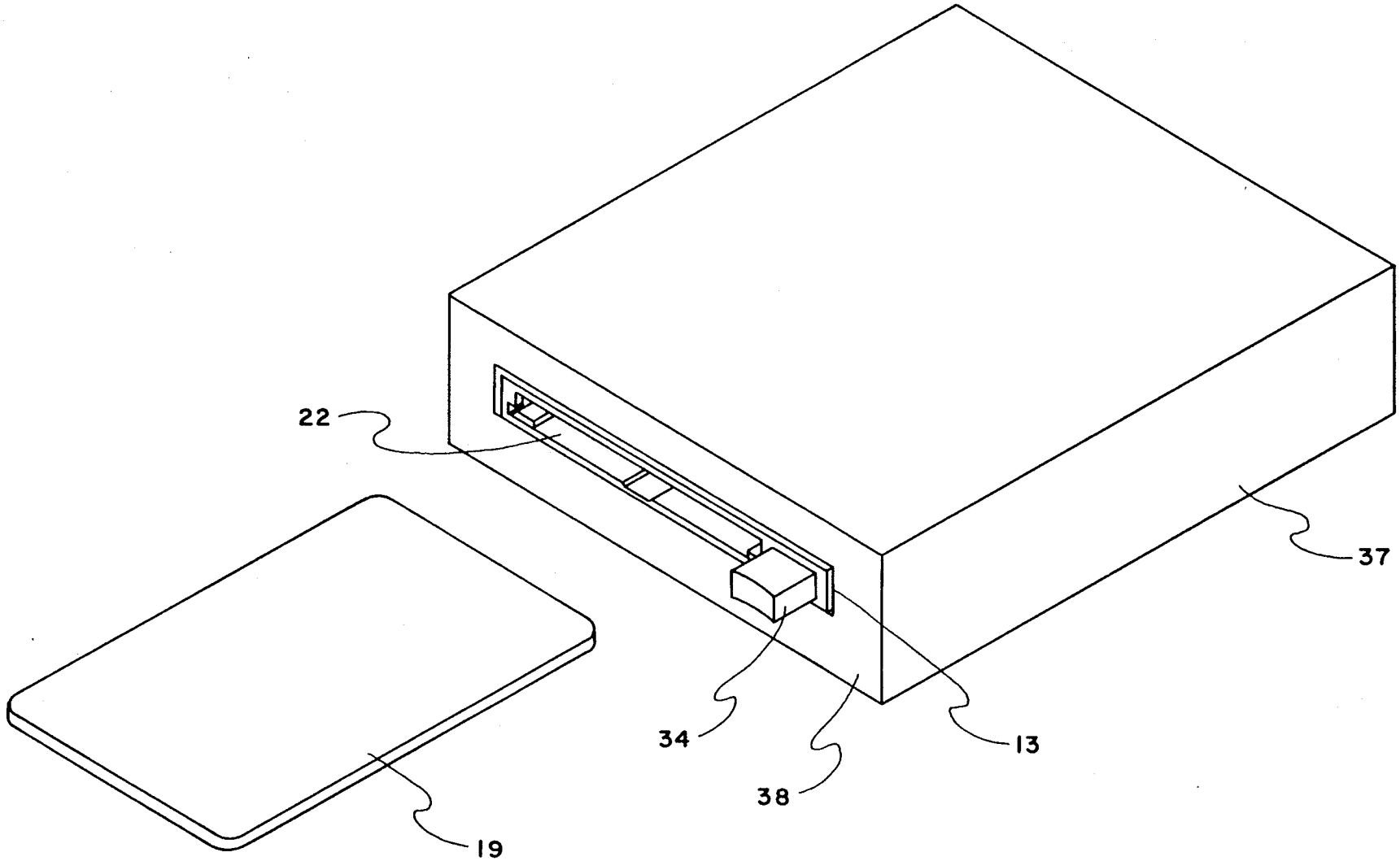
FIG. 5 is a perspective view of the electrical connector of FIG. 2 and a mating element incorporated with the connector.

The ejector 34 is energized in the outward direction by a coil spring 40 and partially projects through the opening 36 from a front surface 38 of a housing 37 which contains the contact holding plate 17 and the frame 13, as shown in FIG. 4 and FIG. 5.

In the above configuration, if the distance from the center of the support 23 to the elongated hole 29 along the lever 27 is designated as a, and if the distance from the support 23 to the groove 32 of the ejector 34 is b, a relationship $a<b$ is set. In this way, a force manually applied to the ejector 34 can be smaller than a force required for releasing the engagement between the pin contacts 15 and the socket contacts against an engaging force therebetween.

Figure 2:
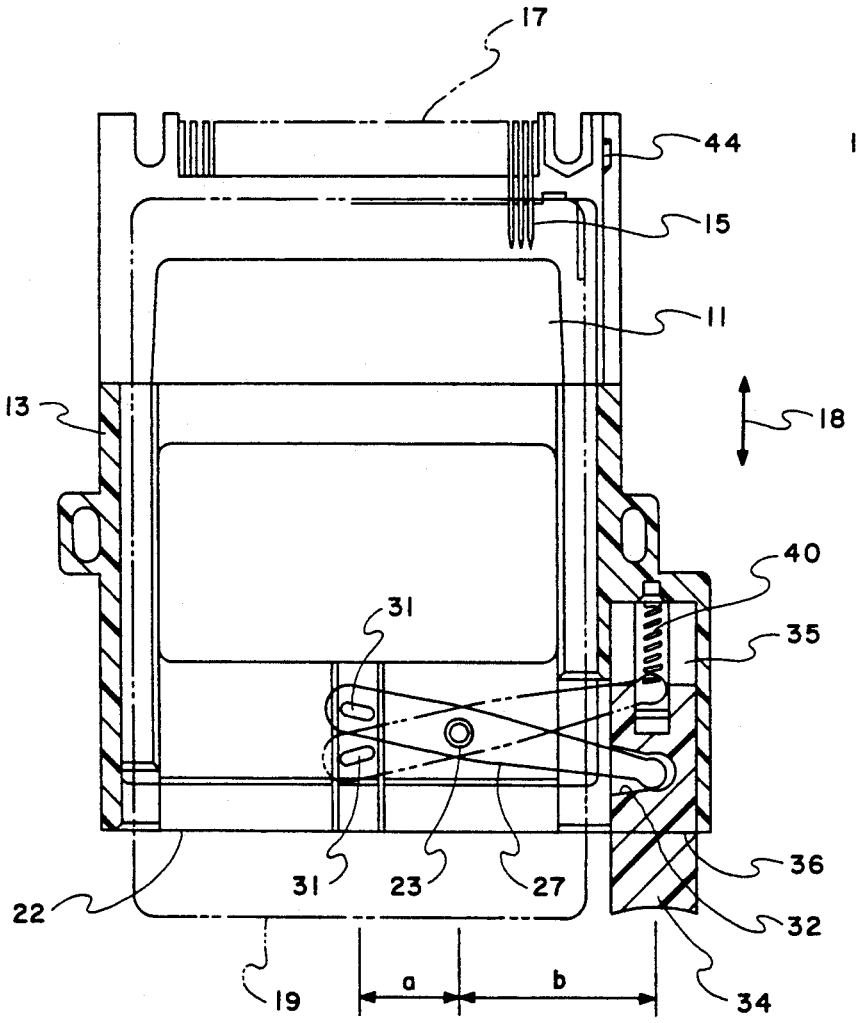
FIG. 2 is a cross-sectional plan view of an electrical connector equipped with a release mechanism according to an embodiment of the present invention.
Figure 3:
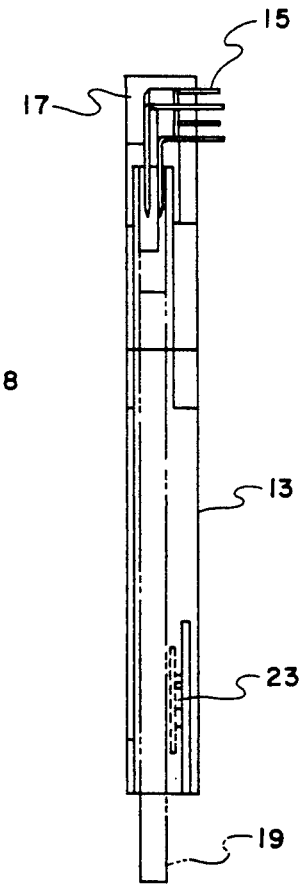
FIG. 3 is a cross-sectional side view of the electrical connector of FIG. 2.
Figure 6:
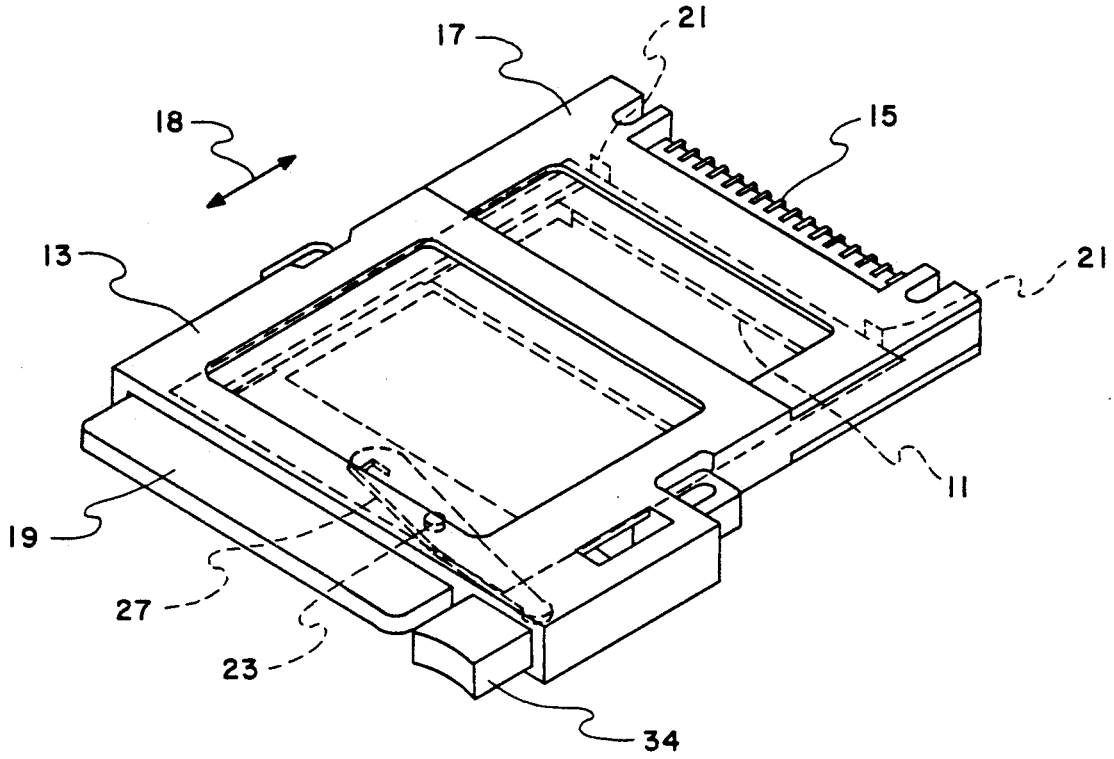
FIG. 6 is a perspective view of the electrical connector of FIG. 2 in a state engaging the mating element.
Figure 7:
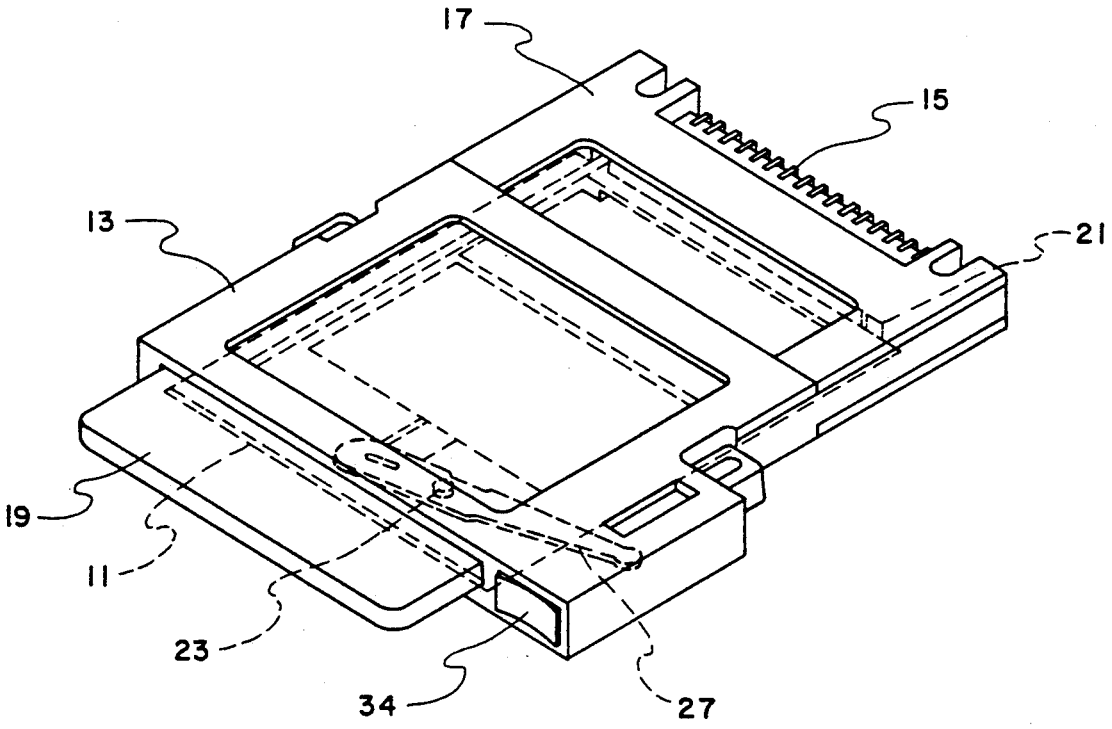
FIG. 7 is a perspective view of the electrical connector of FIG. 2 having the mating element released from the engagement with the connector.

Now referring to FIGS. 6 and 7, the engagement and release of the mating element 19 will be explained below. In the state shown in FIG. 6, the mating element 19 is connected to the connector, that is, the socket contacts connect with and engage pin contacts 15 of the contact holding plate 17. In this state, when the ejector 34 is manually pressed, the lever 27 rotates around the support 23. As a result, the plate 11 moves in the direction 18 of withdrawal from the frame 13 in accordance with the rotation of the lever 27. At this time, the hooks 21 of the plate 11 fit to or engage a leading edge of the mating element 19 so that the mating element 19 is moved together with the plate 11 in the direction 18 of withdrawal. As a result, the mating element 18 is released from the engagement between the pin contacts 15 and the socket contacts as shown in FIG. 7. In the movement of the plate 11, the lever 27 moves from a position indicated by a solid line to that indicated by an imaginary line as shown in FIG. 2. Because the elongated hole 29 and the projection 31 are positioned in the vicinity of the center line of the frame 13 in parallel with the direction 18, the plate 11 can be moved without deflection.

If the hand is detached from the ejector 34 after being pressed, the ejector 34 reverts to the state shown by the solid line in FIG. 2 due to a restoring force of the coil spring 40. Establishment of connection of the mating element 19 is made by pressing the mating element 19 into the frame 13.

The contacts 15 may also be secured directly to the frame 13 without use of a separate piece of the contact holding plate 17.

What is claimed is:

1. An electrical connector having an electric contact and being equipped with a release mechanism for releasing a mating element from engagement with said connector, said mating element having a mating contact for electrically connecting with said contact, said connector comprising;

an insulator frame body having a hollow portion with an open end defined by an inner surface thereof, said electric contact being fixed in the hollow portion for connecting said mating element;

an insulator flat plate having a first surface and an opposite second surface with a size which is similar to said mating element for carrying said mating element on said first surface, said insulator flat plate being slidably mounted in the hollow portion of said frame body to carry said mating element in an engaging and a release direction to connect and disconnect said mating contact with said electric contact, said flat plate having hooking means for mechanically engaging said mating element carried on said flat plate;

fewer means pivotally supported at a position in the vicinity of the open end on said inner surface of said frame body which faces said second surface of said insulator flat plate, said lever means having an end portion which is mechanically coupled with said flat plate and an opposite end portion; and manually-operated means coupled to said opposite end portion of the lever means and manually operated for rotating said lever means to move said flat plate in said release direction so that said mating element on said flat plate can be forcedly released from the connection between said electric contact and said mating contact.

2. An electrical connector as claimed in claim 1, wherein said flat plate is provided with a projection in the vicinity of a central axis thereof in parallel with said release direction and said end portion of the lever means is formed with a slit loosely fitted to said projection.

3. An electrical connector as claimed in claim 1, wherein said lever means is formed so that a portion extending from said end portion to a portion pivotally supported on said frame body is shorter than an opposite portion extending from said opposite end portion to said pivotally supported portion.

4. An electrical connector as claimed in claim 1, wherein said frame body is provided with a chamber adjacent to said hollow portion, said chamber having an opening, said manually-operated means comprising a block body slidably held in said chamber and mechanically coupled with said opposite end portion of the lever means, spring means being disposed within said chamber so as to partially project said block body through said opening by a spring force of said spring means.

5. An electrical connector as claimed in claim 4, wherein said block body having a groove for receiving said opposite end of the lever means to thereby form a mechanical coupling between said block body and said lever means.

* * * * *